US011786090B2

(12) United States Patent
Schneider et al.

(10) Patent No.: US 11,786,090 B2
(45) Date of Patent: Oct. 17, 2023

(54) FLOOR NOZZLE FOR A VACUUM CLEANER AND VACUUM CLEANER

(71) Applicant: Miele & Cie. KG, Guetersloh (DE)

(72) Inventors: Jens Schneider, Werther (DE); Alexander Cordes, Bielefeld (DE); Martin Behrenswerth, Hilter (DE)

(73) Assignee: MIELE & CIE. KG, Guetersloh (DE)

( * ) Notice: Subject to any disclaimer, the term of this patent is extended or adjusted under 35 U.S.C. 154(b) by 539 days.

(21) Appl. No.: 15/864,027

(22) Filed: Jan. 8, 2018

(65) Prior Publication Data

US 2018/0192835 A1 Jul. 12, 2018

(30) Foreign Application Priority Data

Jan. 10, 2017 (DE) ..... 10 2017 100 346.0
Jul. 11, 2017 (DE) ..... 10 2017 115 523.6

(51) Int. Cl.
*A47L 9/02* (2006.01)
*A47L 5/36* (2006.01)
*A47L 9/10* (2006.01)

(52) U.S. Cl.
CPC ..... *A47L 9/02* (2013.01); *A47L 5/362* (2013.01); *A47L 9/102* (2013.01)

(58) Field of Classification Search
CPC ..... A47L 9/02; A47L 5/34; A47L 11/4044; A47L 13/146; A47L 13/258
See application file for complete search history.

(56) References Cited

U.S. PATENT DOCUMENTS 2,520,942 A * 9/1950 Leslie ..... A47L 9/02 15/354
3,085,267 A * 4/1963 Jacuzzi ..... E04H 4/1636 15/1.7
4,240,174 A * 12/1980 Thiem ..... A47L 9/02 15/1.7
5,033,149 A * 7/1991 Russo ..... E04H 4/1636 15/1.7
5,398,361 A * 3/1995 Cason ..... A47L 9/02 15/1.7
2015/0082570 A1* 3/2015 Davidshofer ..... A47L 13/225 15/228
2017/0347852 A1* 12/2017 Dant ..... A47L 9/242

FOREIGN PATENT DOCUMENTS

DE 19608188 C2 9/1997
DE 102008029687 A1 1/2009
EP 2937029 A1 10/2015
EP 2965678 A1 1/2016
WO WO 2017051148 A1 3/2017

* cited by examiner

*Primary Examiner* — Laura C Guidotti
*Assistant Examiner* — Aaron R McConnell
(74) *Attorney, Agent, or Firm* — LEYDIG, VOIT & MAYER, LTD.

(57) ABSTRACT

A floor nozzle for a vacuum cleaner includes a housing including a sole plate which faces a floor surface when in a working position, the sole plate having provided therein a suction opening, the suction opening being surrounded by a rear portion of the sole plate, a front portion of the sole plate, and lateral portions of the sole plate. The rear portion and the lateral portions of the sole plate are deformable.

11 Claims, 4 Drawing Sheets

FLOOR NOZZLE FOR A VACUUM CLEANER AND VACUUM CLEANER

CROSS-REFERENCE TO PRIOR APPLICATION

Priority is claimed to German Patent Application No. DE 10 2017 100 346.0, filed on Jan. 10, 2017, and German Patent Application No. DE 10 2017 115 523.6, filed on Jul. 11, 2017, the entire disclosures of which are hereby incorporated by reference herein.

FIELD

The present invention relates to a floor nozzle for a vacuum cleaner, the floor nozzle having a housing including a sole plate which faces the floor surface when in the working position, the sole plate having provided therein a suction opening, the suction opening being surrounded by a rear portion of the sole plate, a front portion of the sole plate, and lateral portions of the sole plate. The present invention also relates to a vacuum cleaner having such a floor nozzle.

BACKGROUND

Vacuum cleaners are used in private homes and commercial establishments to clean surfaces such as textile floor coverings and smooth floors. In order to pick up dust, a floor nozzle of the vacuum cleaner is continuously moved back and forth on a floor surface. The dust pick-up efficiency of the vacuum cleaner is highly dependent on the design of the floor nozzle. A floor nozzle having a flat sole plate along the suction opening at the sole plate has the disadvantage that when the floor nozzle is moved backward in the working direction during cleaning of, for example, long-pile grounds, the sole plate partially lifts the carpet off the floor surface in response to the user pulling the floor nozzle backward. Thus, the carpet to be cleaned is lifted in the region of highest vacuum, generally in the middle of the oblong suction opening, while at the outer ends of the oblong suction opening, the carpet remains on the floor surface due to the lower vacuum. This partial lifting of the carpet leads to insufficient floor contact, so that the vacuum at the floor nozzle drops to a range where effective pick-up of dust is no longer possible. In order to address this problem, the prior art has proposed sole plates which are slightly curved. However, these have the disadvantage that during forward movement of the floor nozzle in the working direction, they do no optimally rest on the underlying surface to be cleaned and, due to the lack of floor contact, do not optimally clean long-pile carpets, for example. Firstly, the slightly curved sole plates do not comb the carpet to be cleaned in the middle of the suction opening because of the lack of floor contact resulting from the greater distance and, secondly, this lack of floor contact causes the vacuum present at the floor nozzle to drop to a range where optimum cleaning is no longer possible. With a view to reducing the energy consumption of vacuum cleaners, the design of the floor nozzle plays an increasingly important role. The rating of vacuum cleaner fans follows a trend toward less power, which first of all leads to a reduction of the volumetric flow rates available at the floor nozzle. Because of the continuity relationship, this generally results in lower flow velocities at the floor nozzles. Moreover, in order to nevertheless allow for adequate pick-up of dust, the sole plates of the floor nozzles are configured to be movable to ensure an optimum cleaning effect.

DE 196 08 188 C2 describes a floor nozzle for a floor care appliance whose sole plate with the gliding sole can be inclined and moved in several directions to compensate for irregularities in the floor and ensure better floor contact. However, the movability of the sole plate is limited by stops, and the adaptability of the rigid sole plate is limited.

WO 2017/051148 A1 describes a floor nozzle for a floor care appliance where individual portions of the sole plate are movable to compensate for floor contours and to seal the suction opening from the environment. However, the movability of the sole plate is limited by the degrees of freedom of the bearing of the individual portions. In addition, the manufacture of such a floor nozzle is relatively complex and costly.

The approaches described here have the disadvantage that the adaptability of the floor nozzles to the underlying surface to be cleaned is limited, and thus optimum cleaning of the underlying surface is not ensured.

SUMMARY

In an embodiment, the present invention provides a floor nozzle for a vacuum cleaner, the floor nozzle comprising: a housing including a sole plate which faces a floor surface when in a working position, the sole plate having provided therein a suction opening, the suction opening being surrounded by a rear portion of the sole plate, a front portion of the sole plate, and lateral portions of the sole plate, wherein the rear portion and the lateral portions of the sole plate are deformable.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
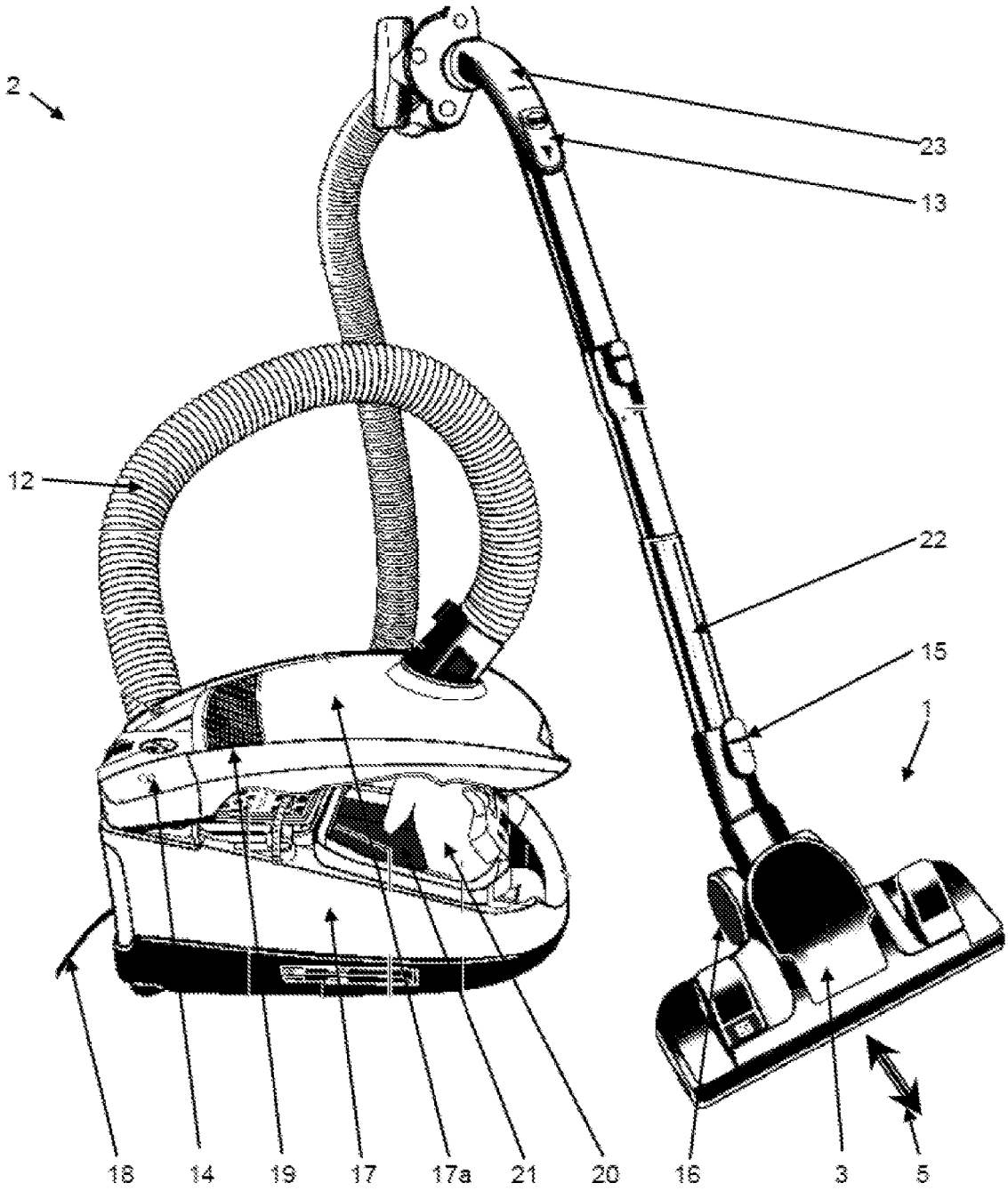
FIG. 1 is a view showing an inventive vacuum cleaner with a floor nozzle.

In an embodiment, the present invention provides a floor nozzle. In an embodiment, the present invention provides a vacuum cleaner with a floor nozzle. Because the rear portion and the lateral portions of the sole plate are made deformable, the floor nozzle can optimally adapt to floor contours during the cleaning operation. This enables effective cleaning of the floor surface at sufficiently high flow velocities, even with low volumetric flow rates.

Using an adaptable floor nozzle, the dust pick-up efficiency can be advantageously increased, in particular on carpeted floors, so that good performance classes and dust pick-up levels can be achieved, even at low input powers. The suction opening rests better on the underlying surface and is capable of cleaning a wide area of the floor surface with a significantly higher flow velocity, without requiring higher volumetric flow rates. The deformable sole plate conforms to the floor bellows, so that the suction opening or suction opening edges rest at least nearly sealingly on the floor covering. This allows the dust pick-up efficiency to be increased without significantly increasing the push forces. In addition, the volume flow rate required for effective cleaning can be further reduced, thereby allowing more economical fans to be installed in the vacuum cleaner. The reduction in volumetric flow rates also leads to reduced flow losses, especially in the case of bagless separators, so that additional energy can be saved here.

The floor surface can be formed by a textile floor covering, such as a carpet or wall-to-wall carpeting, or by hard flooring, such as wooden parquet, laminate or PVC floor covering.

The vacuum cleaner may have a fan for creating a vacuum that causes dust and dirt to be picked up from a floor surface to be cleaned by the floor nozzle as it is moved across the floor surface. To this end, the user moves the floor nozzle back and forth by pulling and pushing movements in the working direction. This causes the floor nozzle to glide across the floor surface to be cleaned. In particular, in the case of long-pile carpets, the sole plate of the floor nozzle glides across the carpet, while in the case of hard floors, the sole plate hovers across these floor surfaces at a distance therefrom, possibly established by spacer bristles. To this end, the user may, for example, manipulate a vacuum cleaner handle connected to the suction wand. For most effective cleaning and care of the floor covering, the suction opening is oblong in shape and extends substantially transversely to the working direction. In this context, "oblong in shape" means that the preferably substantially rectangular suction opening area has a greater length transverse to the working direction than width in the working direction. The suction opening area has a length of preferably between 20 and 30 cm transverse to the working direction and a width of preferably between one and three cm in the working direction. The floor nozzle may also be mounted on an autonomously moving vacuum cleaner, in particular a robot vacuum cleaner, so that the working direction of the floor nozzle corresponds to the direction of travel of the autonomously moving vacuum cleaner. A housing of the vacuum cleaner may have a dust collection chamber in which the dust picked up through the floor nozzle can be collected, for example, in a dust bag.

Advantageous embodiments and refinements of the present invention will become apparent from the following dependent claims.

It is especially preferred that the front portion of the sole plate be made deformable. The deformability of the rear portion, the front portion, and the later portions of the sole plate allows optimum adaptation of the sole plate over nearly its entire base area. By this means, the suction opening of the floor nozzle is sealed off from the environment in all directions during the cleaning operation.

Furthermore, it is preferred that the sole plate be made of an elastic plastic material. It is conceivable for the sole plate to be formed in one piece from an elastic plastic material. This is advantageous, especially with respect to the resulting complexity of manufacture and a homogeneous deformability over the entire area of the sole plate. However, in an alternative embodiment, it is also conceivable to form the sole plate from different plastic materials having different properties in terms of deformability, hardness or friction. This makes it possible to establish specific deformation characteristics in individual portions of the sole plate in order to further improve the cleaning performance.

In an advantageous embodiment of the present invention, the sole plate or sole plate is composed of multiple segments, the individual segments of the sole plate being pivotable relative to one another. A sole plate composed of multiple segments provides excellent adaptability of the floor nozzle to the underlying surface. The floor nozzle is also adaptable to the changing conditions during forward and backward movement of the floor nozzle. This adaptability is provided very simply by making the individual segments of the sole plate pivotable relative to one another.

In an advantageous embodiment, the segments are pivotable relative to one another about respective pivot axes extending parallel to the working direction. Due to the pivot axes extending parallel to the working direction, the segments are suspended such that they can easily adapt to the underlying surface. The pivot axes extending in this manner prevent movement of the segments in the working direction, so that the suction opening edges bounding the suction opening can work effectively on the underlying surface. In the process, especially in the case of long-pile carpets, the suction mouth edges comb the carpet fibers up, thus enabling deep cleaning of the fibers.

In a preferred embodiment, at least one segment is designed to be pivotable from neutral position toward the floor surface. The ability of a segment to pivot from the neutral position toward the floor surface allows for easy but effective adaptation of the floor nozzle to the underlying surface to be cleaned and to the changing conditions during forward and backward movement of the floor nozzle in the working direction.

In a particularly advantageous refinement, the sole plate is formed of two segments having a pivot axis extending centrally therebetween. Such an embodiment is distinguished in particular by the simple design and the good adaptability of the floor nozzle to the underlying surface to be cleaned. The changing conditions during forward and backward movement of the floor nozzle in the working direction are also optimally corrected by the floor nozzle.

In another advantageous embodiment, the sole plate is configured of segments arranged symmetrically with respect to the center of the suction opening. The arrangement of a plurality of segments at the sole plate of the floor nozzle in symmetrical relationship with respect to the center provides for uniform cleaning of the floor surface and offers a high level of adaptability to the underlying surface to be cleaned and to the changing conditions during forward and backward movement of the floor nozzle in the working direction.

An advantageous embodiment of the present invention provides that the segments form at least one lateral margin at the sole plate. By forming the sole plate of movable segments at the margin thereof, the adaptability of the floor nozzle to the underlying surface is improved and the cleaning of corners, such as at baseboards or carpet edges, is optimized.

In an advantageous embodiment of the present invention, the segments are made of a rigid plastic material. The segments formed from rigid plastic material offer a sole plate that is rugged, lightweight and flexibly adaptable to the floor to be cleaned and to the changing conditions during forward and backward movement.

In a preferred embodiment, a hinge is formed between the segments. Providing a hinge between the segments is a simple but effective way to increase the adaptability of the floor nozzle. The hinge defines the pivot axis between the two segments connected by the hinge.

In an advantageous embodiment of the present invention, a spring element is disposed between the segments, the spring element producing a restoring force that returns the segments to a neutral position. Such placement of a spring element between the segments allows the floor nozzle to optimally adapt to the floor surface to be cleaned and to the changing conditions during forward and backward movement. Lifting of the floor nozzle off the underlying surface causes so that the sole plate of the floor nozzle returns to a neutral position.

In an advantageous embodiment, an elastomer is disposed as a hinge between the segments. Placement of an elastomer as a hinge provides a simple but robust way of providing a tight yet adaptable hinge between the segments. Such sealing between the segments makes it possible to effectively achieve that the flow provided by the fan nevertheless flows through the created suction opening.

In a particularly advantageous refinement, the elastomer produces a restoring force that returns the segments to a neutral position. The use of an elastomer as a hinge also makes it possible to produce a restoring force that enables optimum adaptation of the floor nozzle. If the floor nozzle is lifted off the underlying surface, the elastomer causes the sole plate of the floor nozzle to return to a neutral position.

In a preferred embodiment, the sole plate is formed from an elastic plastic material. Making the sole plate from an elastic material provides a particularly adaptable floor nozzle.

In an advantageous embodiment, the suction opening edge is configured to be deformable with the suction opening. A suction mouth edge that is deformable with the suction opening improves the adaptability of the floor nozzle to the underlying surface to be cleaned and ensures that long-pile carpets, in particular, are optimally cleaned by the suction mouth edges during both forward and backward movement of the floor nozzle in the working direction. This arrangement also offers the advantage of ensuring that no areas of the surface to be cleaned are omitted. A sharp-edged configuration of the suction opening edge ensures that the fibers of the carpet pile are effectively bent up. This increases the resistance to pushing on the floor surface only minimally because the suction opening edge adapted to the underlying surface effectively bends up the carpet. Due to the deformable suction opening edge, the traversed carpet fibers are effectively bent up across the entire area of the suction opening without the user having to exert excessive force during forward and backward movement.

It applies to all embodiments that in the initial position or in the neutral position, the underside of the sole plate extends straight or substantially straight in a direction transverse to the working direction. In the event of deformation, the outer ends of the sole plate relative to the central portion thereof deform downwardly, resulting in a curvature in the form of an inverted U as seen from the front. All positions and directions are described herein with reference to the normal use of the floor nozzle.

A further embodiment of the invention provides a vacuum cleaner for cleaning and care of floor surfaces, the vacuum cleaner having a fan for creating a vacuum to cause dirt to be picked up by an air stream, and further having a separating system for cleaning the drawn-in air from dirt. The vacuum cleaner, which has been described already and will be further described below, has a floor nozzle according to the descriptions above and below.

In the figures, an inventive floor nozzle, denoted by reference numeral 1, is shown purely schematically. The view of FIG. 1 shows an inventive vacuum cleaner 2 having a floor nozzle 1 connected thereto. The vacuum cleaner 1 shown in the exemplary embodiment is a so-called canister vacuum cleaner. Floor nozzle 1 is connected via its connecting stub 15 to a preferably telescopic suction wand 22. In this shown exemplary embodiment, floor nozzle 1 has its own housing 3 separate from vacuum cleaner housing 17, 17*a*. Telescopic suction wand 22 merges into a handle 23, to which is connected a suction hose 12, which is connected to vacuum cleaner housing 17, 17*a*. A fan of vacuum cleaner 2 incorporated in vacuum cleaner housing 17, 17*a* is powered via an electrical power cord 18 to create a vacuum. This vacuum causes soil and dirt to be picked up from floor surface 24 to be cleaned (FIG. 4) by an air stream through suction opening 6 (FIG. 5) and carried away through suction wand 22 and suction hose 12 into housing 17, 17*a* of vacuum cleaner 2. This housing 17, 17*a* is provided therein with a separating system 20, which in this exemplary embodiment takes the form of a dust bag. This separating system 20 is located in a dust chamber 21 formed by housing parts 17 and 17*a* of vacuum cleaner 2. This dust chamber 21 is accessible by a hinge mechanism between vacuum cleaner housing parts 17 and 17*a* and shown open, so that separating system 20 is visible and removable. To permit operation of vacuum cleaner 2, dust chamber 21 is closed and a vacuum is created. The air stream produced by the vacuum is freed of soil and dirt in separating system 20 and exhausted from vacuum cleaner 2 through an exhaust grill 19. Vacuum cleaner 2 has a foot switch unit 14 for turning it on and off. This foot switch unit 14 includes switches large enough to be operated by a foot of a user. Foot switch unit 14 typically includes also a switch for operating the automatic winder for power cord 18, which is incorporated in vacuum cleaner housing 17, 17*a*. Furthermore, handle 23 is provided with a hand switch unit 13 which can be used to activate functions of vacuum cleaner 2. Switch unit 13 can also be used to turn vacuum cleaner 2 on and off and to select power levels of the fan. A user of vacuum cleaner 1 can grasp it by handle 23 and thus push floor nozzle 1 back and forth by a pushing and pulling movement in working direction 5, indicated as a double-headed arrow, so as to clean floor surface 24 (FIG. 4). In this process, floor nozzle 1 glides across floor surface 24 to be cleaned (FIG. 4). In particular, in the case of long-pile carpets, sole plate 4 (FIGS. 3, 4 and 5) of floor nozzle 1 glides across floor surface 24 (FIG. 4), while in the case of hard floors, sole plate 4 (FIGS. 3, 4 and 5) hovers across these floor surfaces 24 (FIG. 4) at a distance therefrom, possibly established by spacer bristles. In the exemplary embodiment shown, floor nozzle 1 also has support elements 16 in the form of wheels, which establish a defined distance between sole plate 4 (FIGS. 3, 4 and 5) and floor surface 24 to be cleaned (FIG. 4) and ensure easy handling when pushing floor nozzle 1 back and forth.

Figure 2:
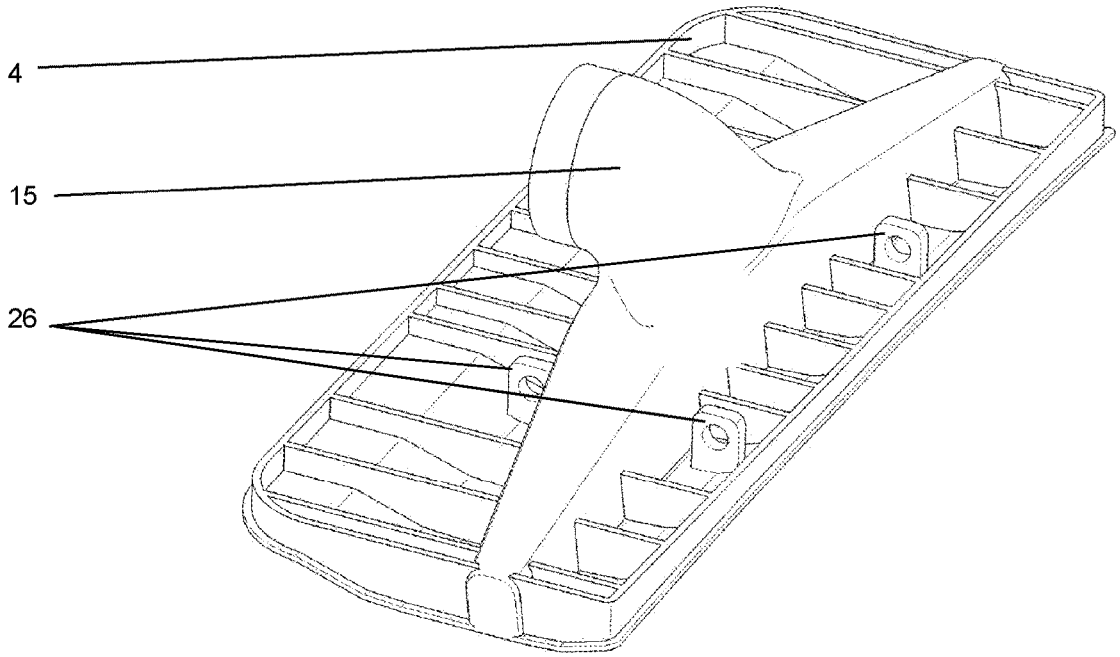
FIG. 2 is a perspective side view of an inventive floor nozzle having a single-piece sole plate.
Figure 5:
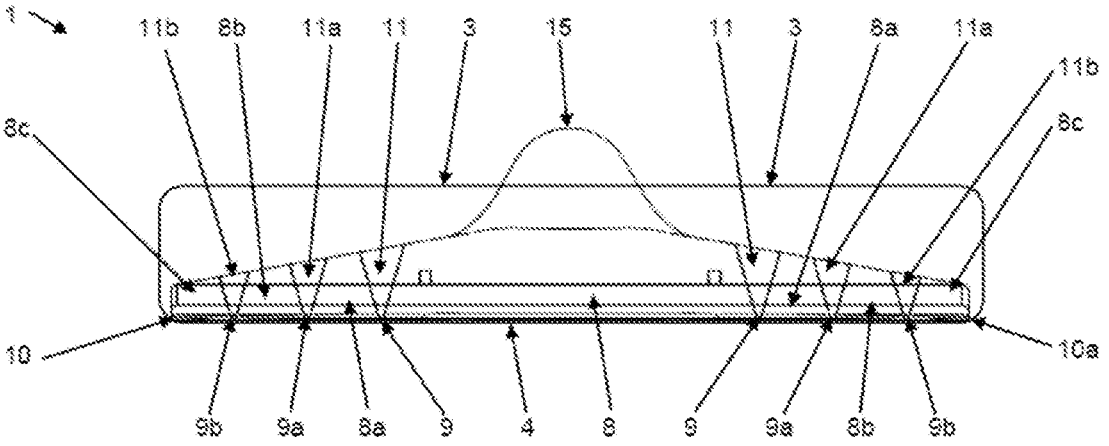
FIG. 5 is a side view of an inventive floor nozzle having a segmented sole plate.

FIG. 2 shows, in perspective side view, parts of the inventive floor nozzle 1 for a vacuum cleaner 2. In the embodiment shown here, sole plate 4 of floor nozzle 1 is a one-piece design. A connecting stub 15 is disposed centrally above sole plate 4. The sole plate 4 shown here is fixed to housing 3 of floor nozzle 1 via suspension elements 26. Sole plate 4 is composed of a flexible plastic material and, therefore, is movable along its entire spatial extent. The deformability of sole plate 4 provides for movability of the sole plate 4 in different directions of movement to enable optimal adaptation of sole plate 4 to floor contours during the cleaning operation. Suction opening edge 7 formed by sole plate 4 is configured to be deformable with suction opening 6 (FIG. 5). The suction opening edge is formed in one piece from the same material as the sole plate. However, in an alternative embodiment, it is also conceivable to form suction opening edge 7 form a dimensionally stable plastic material to achieve improved dust mobilization by suction opening edge 7.

Figure 3:
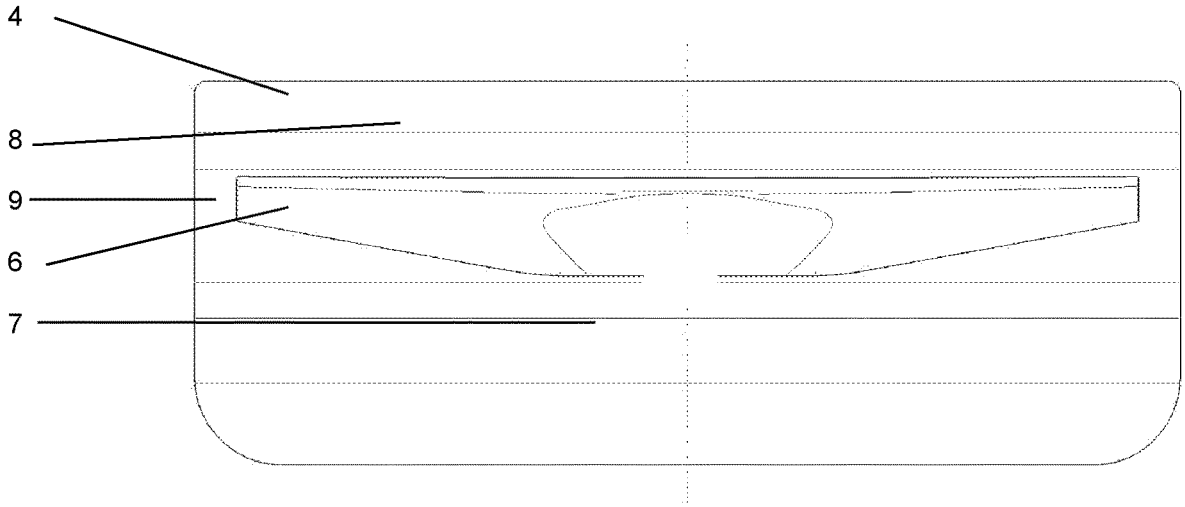
FIG. 3 is a plan view of an inventive floor nozzle having a single-piece sole plate.
Figure 4:
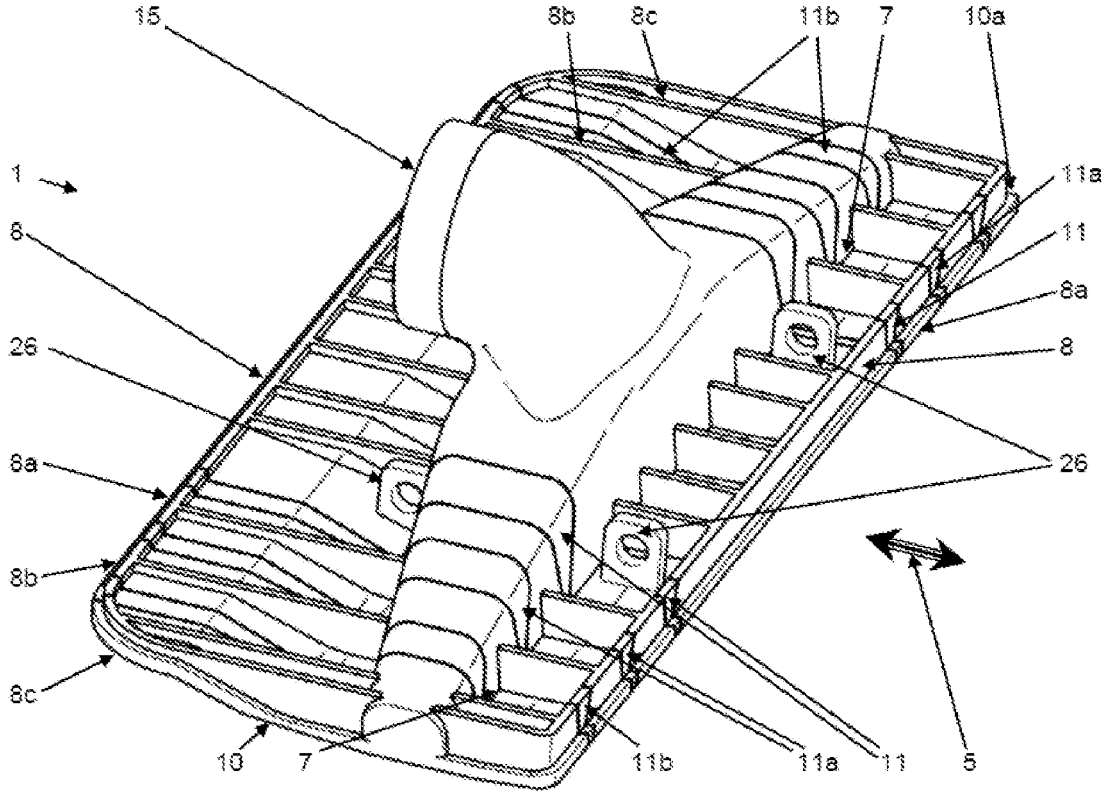
FIG. 4 is a perspective side view of an inventive floor nozzle having a segmented sole plate.

FIG. 3 shows schematically the sole plate 4 of a floor nozzle 1 according to the present invention. As can be seen clearly in this view, the oblong suction opening 6 extends transversely to working direction 5. Suction opening 6 is bounded forwardly and rearwardly in working direction 5 by a suction opening edge formed on sole plate 4. The suction opening 6 shown here extends to the lateral margins 10, 10*a* of sole plate 4. Suction opening 6 is bounded in its base area by a front portion, a rear portion and lateral portions of sole plate 4. The sole plate surface facing the floor covering is substantially straight in shape transversely to the working direction. The front suction opening edge in the working direction extends substantially in a straight line. The rear suction opening edge in the working direction extends in a straight line in the area of connecting stub 15 and approximately parallel to the front suction opening edge. In the marginal regions, the rear suction opening edge tapers toward the front suction opening edge, so that the distance between the front and rear suction opening edges decreases in the marginal regions.

FIG. 4 shows, in perspective side view, parts of the inventive floor nozzle 1 for a vacuum cleaner 2 (FIG. 1). In the embodiment shown here, sole plate 4 of floor nozzle 1 includes a plurality of segments 8, 8*a*, 8*b*, 8*c* which are pivotable relative to one another. The individual segments 8, 8*a*, 8*b*, 8*c* of sole plate 4 are arranged symmetrically with respect to the center of suction opening 6 (FIG. 5) and to connecting stub 15. As the central element, segment 8 carries connecting stub 15, three segments 8*a*, 8*b*, 8*c* in each case being arranged transversely to working direction 5 in such a manner that they are pivotable relative to one another. The respective symmetrical segments 8*a*, 8*b*, 8*c* are provided with the same reference numerals to simplify the explanation. The respective outermost segment 8*c* of sole plate 4 forms a respective lateral margin 10, 10*a*, up to which reaches suction opening 6 (FIG. 5), which extends transversely to working direction 5. Segments 8*a*, 8*b*, 8*c*, which are made of a rigid plastic material, are respectively connected to one another via a hinge 11, 11*a*, 11*b* formed of elastomer. This elastomer 11, 11*a*, 11*b* produces a restoring force that returns segments 8*a*, 8*b*, 8*c* to the neutral position shown here, in which sole plate 4 is preferably flat and oriented parallel to the floor surface. The suction opening edge 7 formed by sole plate 4 is configured to be deformable with suction opening 6 (FIG. 5). The sole plate 4 shown here is fixed to housing 3 of floor nozzle 1 via suspension elements 26.

In FIG. 5, an inventive floor nozzle 1 for a vacuum cleaner for cleaning and care of floor surfaces 24 (FIG. 4) is shown in a schematic view looking at it from working direction 5 (FIGS. 1, 2 and 5). Floor nozzle 1 has a housing 3 (FIGS. 1, 2 and 4) having a sole plate 4 which faces floor surface 24 (FIG. 4) when in the working position. As is readily discernible, connecting stub 15 is disposed centrally in housing 3. Segment 8 of sole plate 4, which is connected to connecting stub 15, has arranged adjacent thereto three additional segments 8*a*, 8*b*, 8*c* on each of the right and left sides in symmetrical relationship. A hinge formed of elastomer 11, 11*a*, 11*b* is disposed between the segments 8, 8*a*, 8*b*, 8*c* respectively. Due to the V-shaped configuration of the hinges formed of elastomer 11, 11*a*, 11*b*, the pivot axes 9, 9*a*, 9*b* extending between the individual segments 8, 8*a*, 8*b*, 8*c* are located close to sole plate 4. In addition, the V-shaped configuration of rubber hinges 11, 11*a*, 11*b* creates a restoring force that returns segments 8*a*, 8*b*, 8*c* to the neutral position shown here. A corresponding orientation of pivotable segments 8*a*, 8*b*, 8*c* is produced during forward movement of floor nozzle 1 in working direction 5 (FIGS. 1, 2 and 5). Because the user exerts pressure on the floor nozzle via the connecting stub, sole plate 4 is pressed into the underlying surface to be cleaned.

Figure 6:
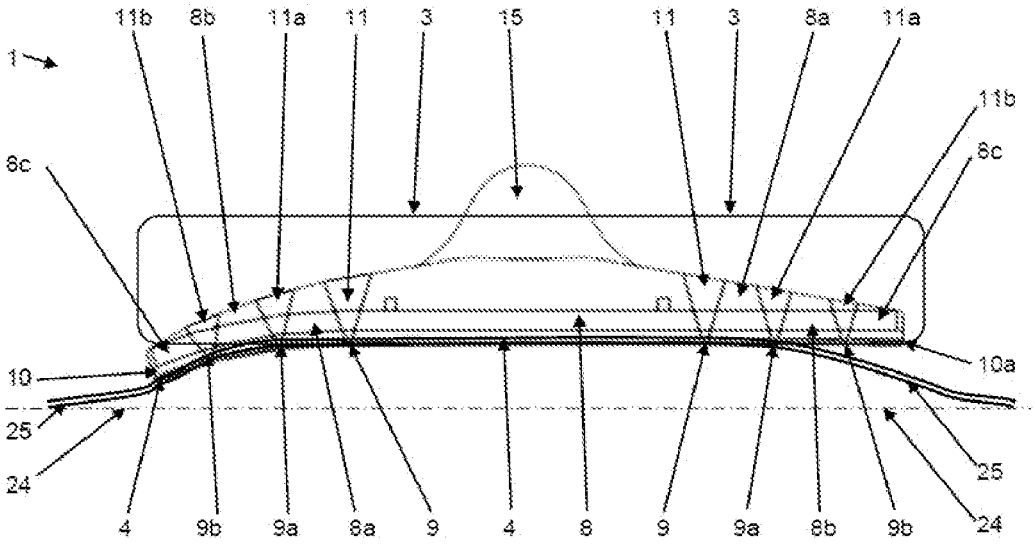
FIG. 6 is a side view of an inventive floor nozzle having a segmented sole plate.

In FIG. 6, an inventive floor nozzle 1 is shown in a schematic view looking at it from working direction 5 (FIGS. 1, 2 and 5). As compared to FIG. 3, the position of pivotable segments 8 *a*, 8 *b* and 8 *c* on the left side is changed. Such an orientation of pivotable segments 8 *a*, 8 *b*, 8 *c* is produced during rearward movement of floor nozzle 1 in working direction 5 (FIGS. 1, 2 and 5). Because the user pulls on floor nozzle 1 via connecting stub 15, floor nozzle 1 lifts rug 25 off the floor surface 24. However, the enhanced adaptability of the floor nozzle 1 provided by deformable sole plate 4 enables optimum cleaning even in this situation. On the left side in FIG. 6, pivotable segments 8 *a*, 8 *b* 8 *c* are appreciably deflected, so that sole plate 4 is still in contact with the lifted rug 25. Because of this, the suction opening edge 7 (FIGS. 1 and 5) formed at suction opening 6 (FIG. 5) can still comb up and deeply clean the fibers of rug 25. The situation shown on the right side of floor nozzle 1 illustrates, by way of example, a floor nozzle 1 that is less adaptable. Here, sole plate 4 no longer rests on rag 25 and the vacuum at floor nozzle 1 drops to a range where effective pick-up of dust is no longer possible. Moreover, sole plate 4 is no longer in contact with rug 25, so that no cleaning takes place in this area. For this reason, it is expedient that the elastomers 11, 11 *a*, 11 *b* disposed between segments 8, 8 *a*, 8 *b* and 8 *c* be made very adaptable so as to enable sufficient deflection of pivotable segments 8 *a*, 8 *b* and 8 *c* of floor nozzle 1. The high level of adaptability of sole plate 4 ensures that lateral margin 10 rests on rug 25 and does not lift off from it, as shown on the side of FIG. 6. The pivoting movement in pivot axis 9 results in a displacement of the pivot axes 9 *a*, 9 *b* located further outward. The pivoting movement enabled by these pivot axes 9 *a*, 9 *b* adds up to the pivoting movement of first pivot axis 9, so that a high number of segments 8, 8 *a*, 8 *b* and 8 *c* and pivot axes 9, 9 *a* and 9 *b* provides a particularly adaptable floor nozzle 1.

Figure 7:
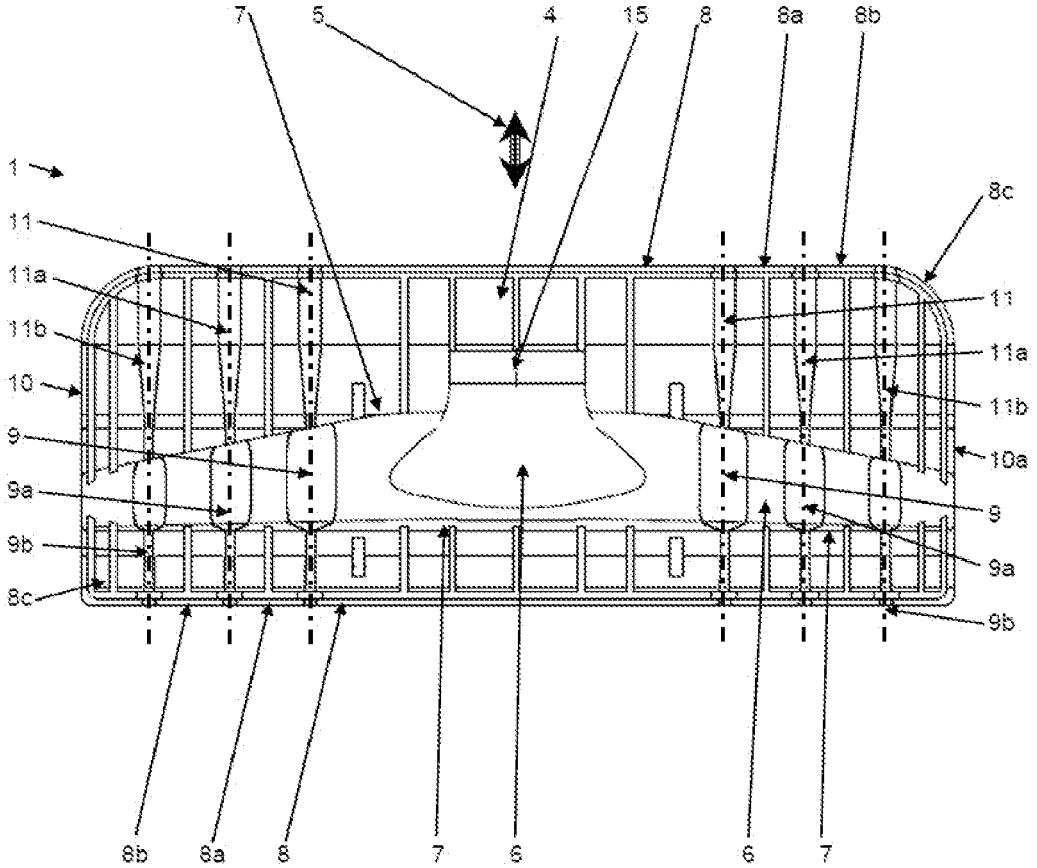
FIG. 7 is a plan view of an inventive floor nozzle having a segmented sole plate.

FIG. 7 shows schematically the sole plate 4 of a floor nozzle 1 according to the present invention. As can be seen clearly in this view, the oblong suction opening 6 extends transversely to working direction 5. Suction opening 6 is bounded forwardly and rearwardly in working direction 5 by a suction opening edge 7 formed on sole plate 4. The suction opening 6 shown here extends to lateral margins 10, 10 *a* of sole plate 4. In FIG. 5, it can readily be seen that the pivot axes 9, 9 *a*, 9 *b* extending parallel to working direction 5 are arranged symmetrically with respect to the center of floor nozzle 1 and connecting stub 15. Elastomers 11, 11 *a* 11 *b* form a significantly widened area in the region of suction opening 6 so as to provide a sufficient degree of pivotability of segments 8 *a*, 8 *b* and 8 *c* at sole plate 4. Overall, it is advantageous to limit the pivotability of sole plate 4; i.e. of the individual segments 8, 8 *a*, 8 *b*, 8 *c*, in the upward direction; i.e., toward the side which faces away from the floor covering, in order for the original shape of sole plate 4, especially the portion facing the floor covering, to be retained on dimensionally stable floor coverings. In this connection, the surface facing floor covering is substantially straight in shape transversely to the working direction. Such limitation is preferably accomplished by stop means provided by the shape given to the connecting sides of the individual segments 8. Projections attached to or formed on the upper side of the sole plate may also serve as stop means. The stop function may also be provided through selection of the hardness of the elastomers that form the hinges.

Of course, the present invention is not limited to the exemplary embodiments shown. Other embodiments are possible without departing from the basic concept thereof. For example, floor nozzle 1 may also be designed as part of an autonomously moving vacuum cleaner.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 floor nozzle
2 vacuum cleaner
3 housing
4 sole plate (gliding sole)
5 working direction
6 suction opening
7 suction opening edge
8 segment of sole plate
9 lateral portion of sole plate
10 lateral margin

What is claimed is:

1. A floor nozzle for a vacuum cleaner, the floor nozzle comprising:

a housing including a sole plate which faces a floor surface when in a working position, the sole plate including a rear portion, a front portion, and lateral portions, the sole plate having provided therein a suction opening, the suction opening being surrounded by the rear portion of the sole plate, the front portion of the sole plate, and the lateral portions of the sole plate, wherein the rear portion and the lateral portions of the sole plate are deformable, and wherein the lateral portions of the sole plate each comprise multiple segments and multiple V-shaped elastomer hinges, each of the V-shaped elastomer hinges pivotably connecting adjacent ones of the segments to one another.

2. The floor nozzle as recited in claim 1, wherein the front portion of the sole plate is deformable.

3. The floor nozzle as recited in claim 1, wherein at least some of the portions of the sole plate are deformable such that they adapt to the floor surface and seal the floor nozzle with respect to the floor surface when the floor nozzle is in a vacuuming operation.

4. The floor nozzle as recited in claim 1, wherein the suction opening has a suction opening edge, the suction opening edge being configured to be movable with the suction opening.

5. The floor nozzle as recited in claim 1, wherein adjacent segments are pivotable relative to one another about respective pivot axes extending parallel to the working direction of the floor nozzle.

6. The floor nozzle as recited in claim 1, wherein at least one segment is pivotable from a neutral position toward the floor surface.

7. The floor nozzle as recited in claim 1, wherein the sole plate comprises two segments having a pivot axis extending centrally therebetween.

8. The floor nozzle as recited in claim 1, wherein the sole plate comprises segments arranged symmetrically with respect to a center of the suction opening.

9. The floor nozzle as recited in claim 1, wherein the segments form at least one lateral margin at the sole plate.

10. The floor nozzle as recited in claim 1, wherein each V-shaped elastomer portion is configured to produce a restoring force that returns adjacent segments to a neutral position.

11. A vacuum cleaner for cleaning and care of floor surfaces, the vacuum cleaner comprising:

a fan configured to create a vacuum to cause dirt to be picked up by an air stream;

a separating system configured to clean the drawn-in air from dirt; and the floor nozzle according to claim 1.

* * * * *